United States Patent [19]

Greminger, Jr. et al.

[11] Patent Number: 4,573,578

[45] Date of Patent: Mar. 4, 1986

[54] METHOD AND MATERIAL FOR THE RESTRAINT OF POLAR ORGANIC LIQUIDS

[75] Inventors: George K. Greminger, Jr.; Richard H. Hall; Mary K. Dehnke, all of Midland, Mich.

[73] Assignee: The Dow Chemical Company, Midland, Mich.

[21] Appl. No.: 562,924

[22] Filed: Dec. 19, 1983

[51] Int. Cl.[4] ..... B65D 85/84

[52] U.S. Cl. ..... 206/524.4; 206/524.5; 53/396

[58] Field of Search ..... 206/584, 524.4, 524.5; 53/396

[56] References Cited

U.S. PATENT DOCUMENTS

| | | | |
|---|---|---|---|
| 3,881,295 | 5/1975 | Derby | 206/524.4 |
| 3,999,653 | 12/1976 | Haigh et al. | 206/584 |
| 4,019,628 | 4/1977 | Derby | 206/524.4 |

*Primary Examiner*—Joseph Man-Fu Moy

[57] ABSTRACT

Safety packages are prepared for transportation of methanol wherein ethyl cellulose having from about 45 to 46.5 weight percent substitution is employed as a sorbent.

12 Claims, 3 Drawing Figures

METHOD AND MATERIAL FOR THE RESTRAINT OF POLAR ORGANIC LIQUIDS

Polar organic liquids such as methanol, ethanol, acetone, nitromethane and the like have found considerable use in commerce as solvents, diluents and the like. Many of such polar organic liquids are flammable and/or toxic and are generally considered to be hazardous liquids. Sometimes in the handling of such polar organic liquids, material escapes from the container in which it is confined and finds its way into a region where it is not desired. Generally, organic liquids are readily handled at least in small quantities by packages such as are disclosed in U.S. Pat. Nos. 3,881,295; 3,999,653 and 4,019,628, the teachings of which are incorporated herewith by reference thereto. A particularly desirable package is disclosed in U.S. Pat. No. 3,999,653, wherein a container such as a glass bottle containing an organic liquid is wrapped in a blanket, the blanket contains particulate polymeric material which readily absorbs most organic liquid. The absorbing materials disclosed in U.S. Pat. No. 3,999,653 provide a highly desirable protective medium for most organic liquids. However, they are relatively ineffective when polar organic materials such as methanol and nitromethane are employed.

It would be desirable if there were available an improved means of handling polar organic liquids.

It would also be desirable if there were available an improved means to restrict the flow of polar organic liquids into undesired regions.

It would also be desirable if there were improved means that would readily sorb polar organic liquids.

These benefits and other advantages are achieved in a means defining a first space containing a polar organic liquid, a second space from which polar organic liquid is to be excluded, at least one body of substituted cellulose disposed between the first and second spaces with the further limitation that in the event the polar organic liquid contacts the substituted ethyl cellulose, a liquid immobilizing gel is formed and thereby preventing the polar organic liquid from entering the second space.

Also contemplated within the scope of the present invention is a method of immobilizing a polar organic liquid, the method comprising providing a first space containing a polar organic liquid and a second space from which the polar organic liquid is to be excluded, disposing at least one body comprising a substituted cellulose between the first and second spaces with the further limitation that in the event polar organic liquid contacts the ethyl cellulose, a liquid immobilizing gel is formed, thereby preventing the polar organic liquid from entering the second space.

Ethyl cellulose suitable for the practice of the present invention is well known and commercially available. However, it can readily be prepared by methods such as are disclosed in U.S. Pat. No. 3,342,805, the teachings of which are herewith incorporated by reference thereto.

Beneficially, for the practice of the present invention, the substituted cellulose should be in a form which has relatively high surface to volume ratios such as granules, filaments, films and the like. For most applications, granules are preferred because of their ready availability and ease of handling.

A wide variety of cellulose materials may be utilized in the practice of the present invention. For most purposes an ethyl cellulose having from about 45 to 46.5 weight percent of ethoxyl substitution and a solution viscosity in the range of 20 to 120 centipoise when measured as a 5 weight percent solution in a mixture which is 80 weight percent toluene and 20 weight percent ethanol using a Ubbelhode viscometer at 25 degrees centigrade is satisfactory. Hydroxy ethyl cellulose can also be employed in the practice of the present invention as well as ethoxy methyl cellulose.

The hereinbefore mentioned cellulose derivatives are also useful when crosslinked with an isocyanate such as toluene, diisocyanate and MDI, or reacted with a compound such as stearyl isocyanate and the like. The suitability of a cellulose derivative for the practice of the present invention is readily determined employing a microscope slide having a specimen well therein and a cover glass commonly employed with microscopic samples. In the event the substituted cellulose is in granular form, one or more granules are placed within the well of the microscope slide and the cover glass positioned so that the glass covers about 90 percent of the area of the well and is in contact with the material in the well. The polar organic solvent under consideration is then added to the microscope slide well in a quantity sufficient to wet the substituted cellulose in the well and provide free liquid. On contact of the polar organic liquid with the cellulose derivative, swelling usually occurs; and if the cover glass raises about 0.2 millimeter on a microscope slide having a well with a depth of 0.8 millimeter, the cellulose derivative is suitable for the practice of the present invention. In the event that the substituted cellulose is in powdered form, a pseudo granule for evaluation is generally readily prepared by placing a drop of the polar organic liquid onto the powder; thereby providing a plurality of powder particles clumped together forming what might be considered to be a synthetic granule; placing the synthetic granule in the well of the microscope slide; positioning the cover glass over most of the well and adding polar organic liquid to the well. If the cover glass raises within 30 minutes, the material is satisfactory. Typical polar organic materials which can be restrained in accordance with the present invention include methanol, ethanol, propanol-1, propanol-2, butanol, 1,1 by weight mixture of ethanol in water, 1,1 by weight of methanol and tertiary butanol, acetone, ethylene glycol methyl ether, ethylene glycol ethyl ether, ethylene glycol butyl ether; as well as the propylene glycol ethers of alcohols containing up to 4 carbon atoms; nitromethane, nitroethane, 1-nitro propane, 2-nitro propane, nitrobutane, acrylic acid, methacrylic acid, propionic acid, acetonitrile, acrylonitrile, methacrylonitrile, 1,1 by weight mixture acetonitrile and water, glacial acetic acid, 1,1 by weight mixture of acetic acid and water, acetone cyanohydrin, epichlorohydrin, ethylene chlorohydrin, dimethylformamide, dimethyl acetamide, tricresylphosphates, adipates and sebacates of alcohols containing up to 4 carbon atoms and phthalates of alcohols containing up to 8 carbon atoms. Substituted celluloses useful in the practice of the present invention are not effective for the containment of dimethyl sulphides, toluenediisocyanate, ethylene glycol and propylene glycol.

In FIG. 1 there is depicted a container in accordance with the invention;

Figure 1:
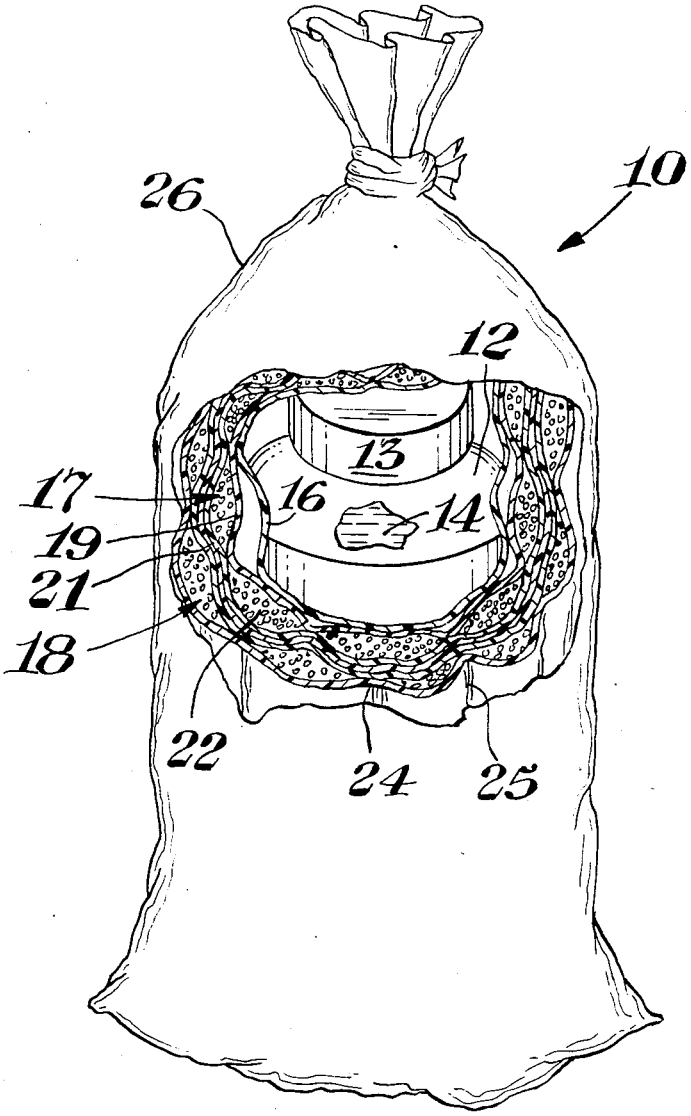

In FIG. 1 there is depicted a partly cutaway view of a package in accordance with the present invention generally designated by the reference numeral 10. The package 10 comprises in cooperative combination a hazardous liquid container 11. The container 11 as depicted in FIG. 1 is a glass bottle having a body 12 and a cap or closure 13. The bottle 12 has disposed therein a hazardous methanol containing liquid 14. The bottle 12 is entirely enclosed within a hazardous liquid permeable container fragment retaining jacket or first jacket 16. The jacket 16 beneficially is a textile fabric of the woven or non-woven variety or perforate synthetic resin film and of sufficient strength to retain at least the larger fragments of the bottle 12 if the bottle is subject to sufficient force to cause rupture thereof. The retaining means or jacket 16 in turn is surrounded by a second jacket 17. The jacket 17 has a first or inner wall 19 and a second or outer wall 21. The inner wall 19 is permeable to the hazardous liquid 14. Disposed generally between the inner wall 19 and the outer wall 21 is a hazardous liquid swellable and permeable body 22 beneficially of a synthetic resin. As depicted in FIG. 1, the body 22 is comprised of a plurality of particles contained between the inner wall 19 and the outer wall 21. The inner wall 19 and the outer wall 21 are joined at locations 24 and 25 and number of other locations not shown, thus providing the jacket 17 with a quilted appearance. The periodic joining of the inner wall 19 and the outer wall 22 maintains the swellable body 22 distributed over the inner surface 19. Over the jacket 17 is disposed a second jacket of like construction with the exception that the jacket 18 contains particulate substituted ethyl cellulose. A package such as the package of FIG. 1 generally would be placed into another container and loose fill dunnage added to the container prior to sealing and shipment. A flexible impact resistant liquid impermeable and generally vapor impermeable outer jacket 26 surrounds and encloses the jacket 17. Beneficially, the jacket 26 is a tough plastic bag.

Figure 2:
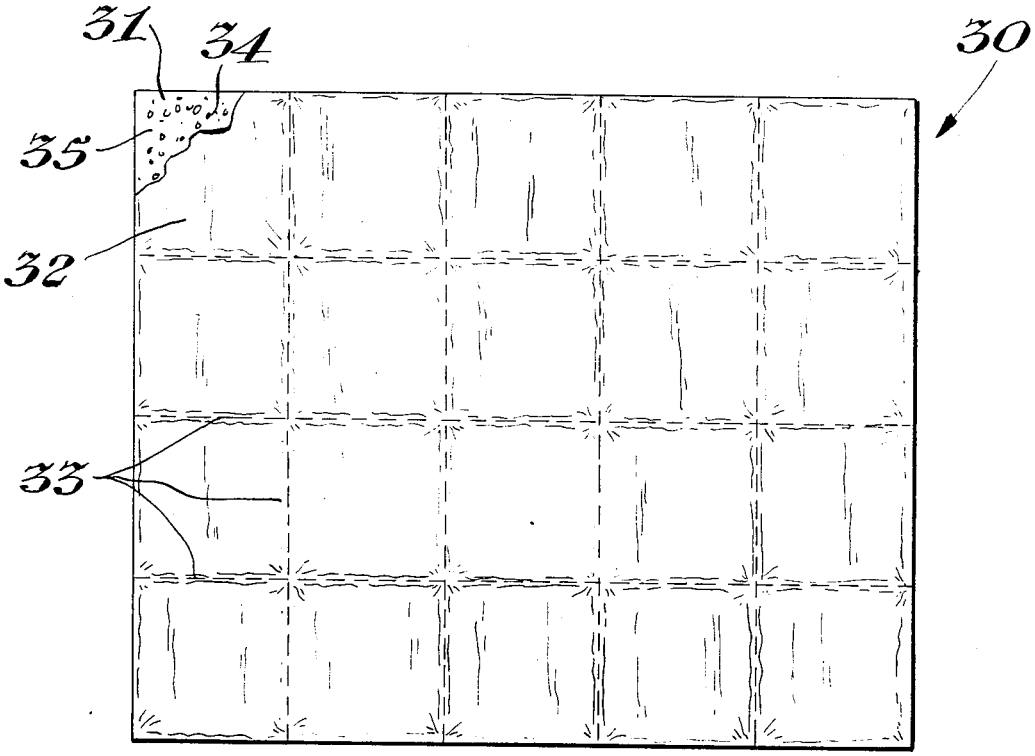
FIG. 2 depicts a blanket in accordance with the present invention.

FIG. 2 schematically depicts a blanket in accordance with the present invention generally designated by the reference numeral 30. The blanket 30 is made of 2 sheets of permeable material, a rear sheet 31 and a forward sheet 32. The sheets 31 and 32 are sewn together by a plurality of seams generally designated by the reference numeral 33 to form a plurality of pockets such as the pocket 35 which as depicted in the drawing has a particulate substituted cellulose designated by the reference numeral 34. A blanket, such as the blanket 30 of FIG. 2 is readily prepared using conventional fabric sewing techniques and is useful in the event of a spill of methanol. A spill may be quickly covered and the material absorbed by the ethyl cellulose and the blanket discarded in an appropriate manner.

Figure 3:
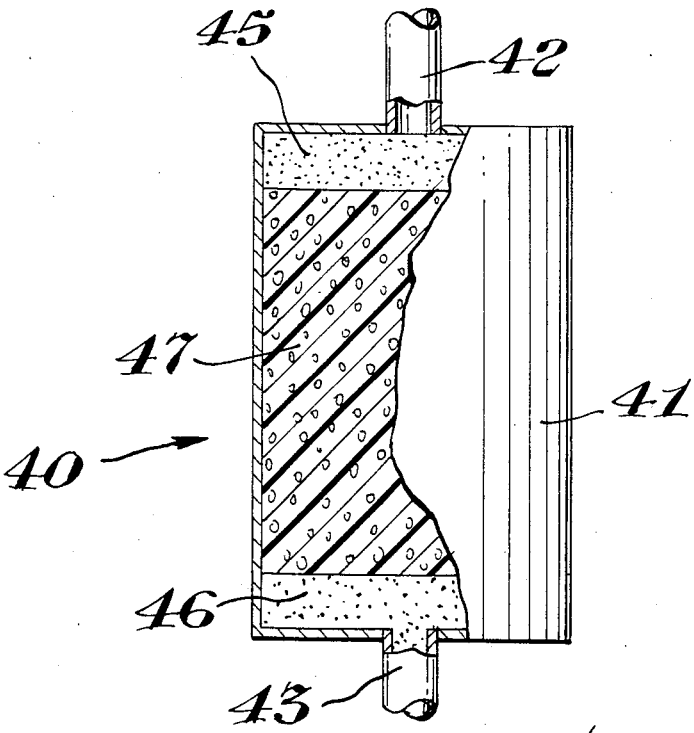
FIG. 3 is a schematic sectional representation of a valve in accordance with the present invention.

In FIG. 3 there is depicted a valve in accordance with the present invention generally designated by the reference numeral 40. The valve 40 comprises a body 41 of generally hollow cylindrical configuration. The body 41 has affixed thereto a first conduit 42 and a second conduit 43, the conduits 42 and 43 providing communication with the space within the body 41. Adjacent conduit 42 is a foraminous retainer 45. A similar retainer 46 is disposed adjacent conduit 43. Such retainers are readily fabricated of foraminous materials such as glass cloth, metal screen and the like. A swellable body of particulate material 47 is disposed within the body 41 and between the retainers 45 and 46. Beneficially, the swellable material 47 is substituted ethyl cellulose of the variety hereinbefore described.

The ethyl cellulose useful in the practice of the present invention may be in powdered form or may be used as a coating on a foraminous substrate such as fabric, paper, paper pulp, textile filaments or particulate material. Oftentimes for maximum effectiveness where barrier properties are desired rather than capability of absorbing relatively large quantities of liquid, a particulate or foraminous body is coated with a cellulose derivative and crosslinked after coating to provide a swellable, insoluble gel forming material which will gel on contact with a polar organic material.

A plurality of substituted cellulose materials were evaluated for imbibing efficiency employing glass tubing having an inside diameter of 8 millimeters. Portions of tubing 8 inches long were plugged at one end with a $\frac{1}{4}$ inch wad of tissue paper. The plugged end was the bottom end of the tube. The cellulosic materials to be evaluated were added to the tubes to a depth of about 3 inches. A second wad of tissue paper having a thickness of about $\frac{1}{8}$ to 1/6 inch was placed over the polymer. The liquid to be tested was then added to the tube to a depth of about 2 inches above the uppermost portion of the cellulosic material being evaluated. The tubes were then observed to determine the depth of penetration of the liquid into the polymer within the tube. An 8 millimeter inside diameter tube was employed as smaller tubes are more sensitive to a wall effect. As the diameter of the tube is increased, less penetration is observed. The penetration was visually observed and measured and provides an excellent indication of the ability of a particular cellulose derivative to swell and seal, which is a function of its polar organic liquid imbibing capability. Generally, the smaller the particle size, the smaller will be the penetration of the liquid into the cellulose derivative. A plurality of cellulose derivatives were uitlized and are designated as follows:

Cellulose A

Hydroxyethyl cellulose having a 51.4 ethoxyl substitution in powdered form.

Cellulose B

An ethyl cellulose powder having 49 weight percent ethoxy substitution.

Cellulose C

A granular methyl ethyl cellulose having 46 weight percent ethoxy substitution.

Cellulose D

Was prepared by slurrying 30 grams of an ethyl cellulose, 46 weight percent ethoxyl content in 500 grams of heptane; 15 grams of phenol isocyanate; 0.5 gram of dibutyltin diacetate was added into the mixture, stirred for 4 hours at a temperature of 70°. The reaction mixture was cooled, filtered and dried. The product was in the form of small granules.

Cellulose E 60 grams of ethyl cellulose having methoxyl content of about 46 weight percent was stirred in 500 grams of ethyl acetate at a temperature of 70° C. A 6 gram portion of stearyl isocyanate and 0.2 gram of dibutyltin diacetate were added. The reaction mixture was agitated for 4 hours, cooled and ethyl acetate removed by evaporation. The product was ground to pass through a 20-mesh screen.

Cellulose F 60 grams of ethyl hydroxylethyl cellulose was slurried in 600 grams of hexane. The mixture was stirred at room temperature with 1 gram of toluene diisocyanate and 0.1 gram of dibutyltin diacetate for a period of 4 hours. The mixture was allowed to stand overnight without agitation and subsequently filtered and washed with hexane. The reaction product was yellowish in color and was ground to pass through a 20-mesh screen.

Cellulose G

A 60-gram portion of ethyl hydroxy ethyl cellulose was disbursed with agitation in 600 grams of hexane. To this slurry was added 4 grams of toluene diisocyanate, and 0.2 gram of dibutyltin diacetate. The resultant mixture was stirred for a period of 5 hours. The product was recovered by filtering and washing the resultant granules with hexane. The resultant product was in the form of small granules.

Cellulose H

A slurry was prepared consisting of 50 grams of substituted cellulose containing about 29 weight percent methoxyl substitution and about 10 weight percent hydroxy propyl substitution, all percentages being by weight, into 500 milliliters of toluene. An excess of sodium hydroxide was added to the mixture and was agitated for a period of 2 hours. The mixture was then placed in a sealed agitated reactor and ethyl chloride added in a quantity calculated to react with the unsubstituted hydroxyl groups of cellulose. The temperature of the reaction mixture was raised to 140° C. and held at that temperature for a period of 6 hours. The mixture was subsequently cooled with agitation. The product was recovered by filtering and washing by toluene. The granular product obtained was ground to pass through a 20-mesh screen. The final product contained 17.5 weight percent methoxyl substitution, 7.5 weight percent hydroxypropyl substitution and 13.3 weight percent ethoxyl substitution.

Cellulose I

A slurry of 500 milliliters of toluene was made employing 50 grams of substituted cellulose containing about 29 weight percent methoxyl substitution and about 6 percent hydroxypropyl substitution. An excess of sodium hydroxide was added and the mixture allowed to equilibrate for a period of about 2 hours at room temperature. At the end of this period of time, the mixture was placed in a sealed agitated reactor and a quantity of ethyl chloride added thereto which was calculated to react with the remaining hydroxyl groups of the substituted cellulose. The temperature of the reaction mixture was then raised to about 140° C. and maintained at that temperature for a period of 6 hours with agitation. The reaction mixture is then cooled to room temperature and the product recovered by filtering and washing with toluene. When dry, the mixture was drawn to press through a 20-mesh screen. Analysis of the final product indicated 26.2 weight percent methoxyl substitution, 5.6 weight percent hydroxypropyl substitutes and 10.7 weight percent ethoxyl substitution. The results are set forth in the following Table wherein the depth of penetration in an 8 millimeter diameter tube is indicated in inches.

TABLE

| | Methanol | Ethanol | Propanol-1 | Acetone | Nitro-methane | Ethylene Glycol Monomethyl Ether | 1,1 Mixture of Acrylonitrile and Acetonitrile | Epichloro-hydrin | Acetic Acid | Dimethyl-formamide |
|---|---|---|---|---|---|---|---|---|---|---|
| A | ¼ | ¼ | ¼ | ⅛ | 1 | ½ | ¾ | ¼ | ⅛ | ½ |
| B | ⅛ | ¼ | ⅜ | ¼ | 1 | ¼ | ⅛ | ¼ | ⅛ | ⅛ |
| C | ¼ | ⅜ | ½ | ⅜ | ¾ | ½ | ½ | ½ | ⅜ | ⅜ |
| D | ½ | ⅜ | ½ | ⅜ | 2½ | ½ | 2 | 2¼ | ¼ | 1½+ |
| E | ½ | ⅜ | ½ | ¼ | BT | 2½ | 2 | ¾ | ½ | ⅜ |
| F | ¼ | ⅛ | ⅜ | ⅜ | ¼ | ¼ | ¼ | 3/16 | ¼ | 3/16 |
| G | ⅜ | ⅜ | ½ | ¼ | 2 | 1 | 2 | ⅜ | ½ | ½ |
| H | ½ | ½ | 1 | 1 | 2+ | 1¼ | 1¼ | ¾ | ½ | — |
| J | ½ | 1½ | ½+ | 1 | 1½+ | 2+ | ½ | 1+ | 1+ | — |

By way of further illustration, a cellulose packing material commercially available under the trade name KIMPAK was coated with a solution of ethyl cellulose having 46 weight percent ethoxyl content dissolved in a 1:1 by volume mixture of methylene chloride and ethanol. The saturated cellulosic packing material was air dried to provide a rigidized paper. The rigidized paper was placed in a Waring blender with water and beaten to a pulp. The resultant pulp was recovered by filtering and dried in air. A portion of the pulp was then placed in a vertically positioned ½ inch inside diameter glass tube which as 12 inches in length and had a porous plug in the bottom thereof. The pulp had a depth of about 3 inches immediately above the porous plug. Water was added to the tube. Water passed through the pulp and porous plug radially. When the level of water reached the top of the pulp, ethanol was added to the tube. In a short time, the ethanol level remained generally constant indicating that the ethyl cellulose had swollen to block the flow of liquid.

A second sample of the cellulosic packing material (KIMPAK) was saturated with a solution of ethylhydroxyethyl cellulose, air dried and pulped with water in a Waring blender. The pulp was recovered by filtering, and air dried. The dried pulp was disbursed in hexane in an air driven Waring blender. The pulp was then treated in hexane for 6 hours with toluene diisocyanate at a temperature of 50° C. At the end of that period of time, the pulp slurry was cooled to room temperature, filtered, the pulp washed with hexane and air dried. A portion of the pulp was inserted into a steel tube having a screen on one end. The pulp was packed against the screen by the addition of ethanol to the tube and applying a pressure of 15 pounds per square inch gauge. No seepage of ethanol through the pulp was observed. Similar results were obtained when the cellulosic material used was a cellulosic string material as utilized in string wound filters, substituted for the packing material KIMPAK.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention, excepting as it is set forth and defined in the hereto-appended claims.

We claim:

1. A device for restraining polar organic liquids comprising a means defining a first space containing a polar organic liquid, a second space from which polar organic liquid is to be excluded, and having at least one body of substituted cellulose disposed between the first and second spaces with the further limitation that in the event the polar organic liquid contacts the substituted cellulose, a liquid immobilizing gel is formed which thereby prevents the polar organic liquid from entering the second space.

2. The device of claim 1 wherein the means defining a first space contains methanol in a glass bottle.

3. The device of claim 2 wherein the body of cellulose is ethyl cellulose contained between opposed foraminous sheets.

4. The means of claim 3 wherein the bottle is surrounded by an oil imbibing body.

5. The means of claim 1 comprising a body of ethyl cellulose restrained between at least two foraminous restraining means and disposed within a conduit.

6. A method of immobilizing a polar organic liquid, the method comprising providing a first space containing a polar organic liquid and a second space from which the polar organic liquid is to be excluded, disposing at least one body comprising a substituted cellulose between the first and second spaces with the further limitation that in the event polar organic liquid contacts the substituted cellulose, a liquid immobilizing gel is formed, which thereby prevents the polar organic liquid from entering the second space.

7. The method of claim 6 wherein the first space is defined by a glass bottle and the organic liquid is methanol.

8. The method of claim 7 wherein the bottle is surrounded by the substituted cellulose in an amount sufficient to absorb the methanol contained therein.

9. The method of claim 8 wherein the substituted cellulose is contained between flexible foraminous sheets.

10. The method of claim 9 including surrounding the bottle with an oil imbibing body.

11. The method of claim 6 wherein the body of substituted cellulose is restrained between opposed foraminous retainers and disposed within a conduit.

12. The method of claim 6 wherein the substituted cellulose is ethyl cellulose.

* * * * *